US008770007B2

(12) United States Patent
Munn et al.

(10) Patent No.: US 8,770,007 B2
(45) Date of Patent: Jul. 8, 2014

(54) STAMP FOR GROUND BONDING STRAP

(71) Applicant: CenturyLink Intellectual Property LLC, Denver, CO (US)

(72) Inventors: Matthew Aaron Munn, Gardner, KS (US); Doug Klamm, Wellsville, KS (US)

(73) Assignee: CenturyLink Intellectual Property LLC, Denver, CO (US)

( * ) Notice: Subject to any disclaimer, the term of this patent is extended or adjusted under 35 U.S.C. 154(b) by 0 days.

(21) Appl. No.: 13/887,734

(22) Filed: May 6, 2013

(65) Prior Publication Data

US 2013/0233041 A1 Sep. 12, 2013

Related U.S. Application Data

(60) Division of application No. 12/410,247, filed on Mar. 24, 2009, now Pat. No. 8,453,486, which is a continuation of application No. 12/123,011, filed on May 19, 2008, now Pat. No. 7,591,696.

(51) Int. Cl.
*B21D 17/02* (2006.01)

(52) U.S. Cl.
USPC ..... 72/414; 72/379.2; 72/475

(58) Field of Classification Search
USPC ..... 72/342.1, 342.7, 342.8, 332, 333, 72/379.2, 412, 414, 415, 416, 470, 474, 72/475
See application file for complete search history.

(56) References Cited

U.S. PATENT DOCUMENTS

| | | | | | |
|---|---|---|---|---|---|
| 271,178 | A | * | 1/1883 | Wieser | 72/474 |
| 298,565 | A | * | 5/1884 | Fastenrath | 160/229.1 |
| 442,430 | A | * | 12/1890 | Fontaine | 72/328 |
| 696,753 | A | * | 4/1902 | Robison | 72/464 |
| 1,005,980 | A | | 10/1911 | Katzinger | |
| 1,560,308 | A | | 11/1925 | Perry | |
| 1,887,732 | A | | 11/1932 | Pagel et al. | |
| 2,086,152 | A | | 7/1937 | Bedell | |
| 2,247,041 | A | | 6/1941 | Bergan | |
| 2,323,758 | A | * | 7/1943 | Temple, Jr. | 72/333 |
| 3,143,595 | A | | 8/1964 | Martin | |
| 3,173,991 | A | | 3/1965 | Breakfield, Sr. | |
| 3,485,079 | A | | 12/1969 | Bogaert | |

(Continued)

FOREIGN PATENT DOCUMENTS

JP 56-154217 * 11/1981 ..... B21C 37/06

OTHER PUBLICATIONS

U.S. Appl. No. 11/904,556; Examiner Interview Summary dated May 10, 2010; 3 pages.

(Continued)

*Primary Examiner* — Edward Tolan
(74) *Attorney, Agent, or Firm* — Swanson & Bratschun, L.L.C.

(57) ABSTRACT

A system and method forming a ground bonding strap. A length of cable is measured to determine a segment of cable to stamp to form a pair of connectors. The segment is heated. The segment is stamped to form the pair of connectors. The pair of connectors defining an indentation and a pair of receptacles disposed through the cable. The pair of receptacles being each adjacent to and separated by an indentation. The indentations being positioned to allow a user to cut between the pair of connectors to form a ground bonding strap of a length selected by the user.

20 Claims, 8 Drawing Sheets

(56) References Cited

U.S. PATENT DOCUMENTS

| | | | | |
|---|---|---|---|---|
| 3,683,167 | A | 8/1972 | Rishton | |
| 3,775,791 | A | 12/1973 | Grube | |
| 3,864,008 | A | 2/1975 | Bakermans et al. | |
| 4,004,447 | A * | 1/1977 | Wantling | 72/414 |
| 4,191,123 | A | 3/1980 | Luc | |
| 4,394,533 | A | 7/1983 | Naito | |
| 4,523,445 | A | 6/1985 | Yoshida | |
| 4,672,198 | A | 6/1987 | Presby | |
| 4,834,682 | A | 5/1989 | Auclair et al. | |
| 4,850,214 | A | 7/1989 | Opprecht et al. | |
| 4,973,370 | A | 11/1990 | Kreinberg | |
| 5,030,797 | A | 7/1991 | Logstrup | |
| 5,574,813 | A | 11/1996 | Choduba et al. | |
| 5,605,474 | A | 2/1997 | Auclair | |
| 5,612,780 | A | 3/1997 | Rickenbach et al. | |
| 5,632,180 | A | 5/1997 | Doose | |
| 5,634,254 | A | 6/1997 | Calmettes et al. | |
| 5,664,957 | A | 9/1997 | Starr | |
| 5,757,997 | A | 5/1998 | Birrell et al. | |
| 5,761,360 | A | 6/1998 | Grois et al. | |
| 5,791,186 | A | 8/1998 | Nishida et al. | |
| D400,169 | S | 10/1998 | Endo | |
| 5,818,993 | A | 10/1998 | Chudoba et al. | |
| 6,064,791 | A | 5/2000 | Crawford et al. | |
| 6,230,406 | B1 | 5/2001 | Balfour et al. | |
| 6,373,562 | B1 | 4/2002 | Marsh et al. | |
| 6,401,510 | B1 | 6/2002 | Morse et al. | |
| 6,688,777 | B1 | 2/2004 | Ostrander et al. | |
| 6,741,786 | B2 | 5/2004 | Flower et al. | |
| 6,821,025 | B2 | 11/2004 | Gerhard | |
| 6,973,252 | B2 | 12/2005 | Doss et al. | |
| 7,260,970 | B2 * | 8/2007 | Chang | 72/338 |
| 7,591,696 | B1 | 9/2009 | Munn et al. | |
| 7,681,313 | B2 | 3/2010 | Zurawel et al. | |
| 7,787,739 | B2 | 8/2010 | Munn | |
| 8,453,486 | B2 | 6/2013 | Munn et al. | |
| 2009/0060418 | A1 | 3/2009 | Munn | |
| 2009/0103870 | A1 | 4/2009 | Solomon et al. | |
| 2009/0282888 | A1 | 11/2009 | Munn et al. | |

OTHER PUBLICATIONS

U.S. Appl. No. 11/904,556; Final Rejection dated Apr. 14, 2010; 17 pages.
U.S. Appl. No. 11/904,556; Issue Notification dated Aug. 11, 2010; 1 page.
U.S. Appl. No. 11/904,556; Non-Final Office Action dated Sep. 16, 2009; 11 pages.
U.S. Appl. No. 11/904,556; Notice of Allowance dated May 27, 2010; 20 pages.
U.S. Appl. No. 11/904,556; Notice Regarding a Non-Compliant Response/Amendment dated Feb. 2, 2010; 4 pages.
U.S. Appl. No. 12/123,011; Amendment after Notice of Allowance (Rule 312) filed Jul. 8, 2009; 31 pages.
U.S. Appl. No. 12/123,011; Amendment and Request for Reconsideration filed Mar. 16, 2009; 16 pages.
U.S. Appl. No. 12/123,011; Examiner Interview Summary dated Mar. 13, 2009; 2 pages.
U.S. Appl. No. 12/123,011; Issue Notification dated Sep. 2, 2009.
U.S. Appl. No. 12/123,011; Non-Final Rejection dated Feb. 18, 2009; 11 pages.
U.S. Appl. No. 12/123,011; Notice of Allowance dated May 29, 2009; 8 pages.
U.S. Appl. No. 12/123,011; Notice of Drawing Inconsistency with Specification dated Jun. 18, 2009; 1 page.
U.S. Appl. No. 12/123,011; Requirement for Restriction/Election dated Dec. 18, 2008; 7 pages.
U.S. Appl. No. 12/123,011; Response to Amendment Under Rule 312 dated Jul. 9, 2009; 2 pages.
U.S. Appl. No. 12/123,011; Response to Election/Restriction Requirement filed Jan. 9, 2009; 4 pages.
U.S. Appl. No. 12/410,247; Final Rejection dated Oct. 30, 2012; 10 pages.
U.S. Appl. No, 12/410,247; issue Notification dated May 15, 2013; 1 page.
U.S. Appl. No. 12/410,247; Miscellaneous Communication dated Apr. 15, 2013; 3 pages.
U.S. Appl. No. 12/410,247; Non-Final Rejection dated May 24, 2012; 14 pages.
U.S. Appl. No. 12/410,247; Notice of Allowance dated Feb. 6, 2013; 15 pages.
U.S. Appl. No. 12/410,247; Response to Restriction Requirement filed Mar. 14, 2012; 5 pages.
U.S. Appl. No. 12/410,247; Response to Rule 312 Communication dated Apr. 26, 2013; 2 pages.
U.S. Appl. No. 12/410,247 Response/Amendment after a Notice of Allowance filed Apr. 17, 2013; 31 pages.
U.S. Appl. No. 12/410,247; Restriction Requirement dated Feb. 28, 2012; 4 pages.

* cited by examiner

STAMP FOR GROUND BONDING STRAP

PRIORITY

Cross Reference to Related Application

This application is a division of U.S. patent application Ser. No. 12/410,247, filed Mar. 24, 2009, and entitled: System and Method for Creating a Ground Bonding Strap, which is a continuation of U.S. patent application Ser. No. 12/123,011 (now U.S. Pat. No. 7,591,696), filed on May 19, 2008, and entitled: Ground Bonding Strap, which is hereby incorporated by reference in its entirety.

BACKGROUND

The use of and development of communications has grown nearly exponentially in recent years. The growth is fueled by larger networks with more reliable protocols and better communications hardware available to service providers and consumers. In order to meet these customer and business needs, communications equipment has been installed at a breakneck pace. A large portion of communications equipment and projects require grounds to ensure proper functionality and safety.

Some ground connectors may require in-field customization which may include multiple steps of cutting, stripping, and crimping. Other grounding equipment is mass produced at specifications that may not closely match each project. The various forms of ground connections may experience failures at any number of points. As a result, materials and effort may be wasted.

SUMMARY

One embodiment provides a system and method forming a ground bonding strap. A length of cable may be measured to determine a segment of cable to stamp to form a pair of connectors. The segment may be heated. The segment may be stamped to form the pair of connectors. The pair of connectors may define an indentation and a pair of receptacles disposed through the cable. The pair of receptacles may be each adjacent to and separated by an indentation. The indentations may be positioned to allow a user to cut between the pair of connectors to form a ground bonding strap of a length selected by the user.

Another embodiment provides a ground bonding stamp. The ground bonding stamp may include a heating element operable to heat a segment of a cable for stamping at intervals of a length of the cable. The ground bonding stamp may further include a die including a pair of teeth operable to stamp a first side of the segment to form a pair of connectors. The die may include an indentation tooth for forming an indentation separating the pair of connectors. The ground bonding stamp may further include a punch defining a pair of sockets operable to stamp a second side of the segment to form the pair of connectors. The sockets may be operable to receive the teeth as pushed through the cable to form a pair of through holes within the pair of connectors. The punch may include the indentation tooth for forming the indentation separating the pair of connectors. The ground bonding stamp may further include a hydraulic press connected to the punch and the die operable to press the punch and the die together at the heater portion of the cable to form the pair of connectors.

Another embodiment provides a method of forming a ground bonding strap. A length of braided cable may be measured at an interval to determine a segment of cable to stamp to form a pair of connectors. The segment may be heated. The segment may be stamped with a hydraulic press to form the pair of connectors. The pair of connectors may define an indentation on both sides of the braided cable and a pair of receptacles disposed through the cable. The indentations may be positioned to allow a user to cut between the pair of connectors to form a ground bonding strap of a length selected by the user. The measuring, heating and stamping may be performed a plurality of times for an entire length of the braided cable. The hydraulic stamp may include a die including a pair of teeth operable to stamp a first side of the segment to form the pair of connectors. The die may include an indentation tooth for forming the indentation separating the pair of connectors. The hydraulic stamp may further include a punch defining a pair of sockets operable to stamp a second side of the segment to form the pair of connectors. The sockets may be operable to receive the teeth as pushed through the braided cable to form the pair of receptacles within the pair of connectors. The punch may include the indentation tooth for forming the indentation separating the pair of connectors.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

The illustrative embodiments provide a ground bonding strap as well as a method of manufacturing and utilizing a ground bonding strap. The ground bonding strap or grounding bonding strap is a wired connector for grounding one or more elements that require a connection to ground. In one embodiment, the ground bonding strap may be utilized for communications equipment. Alternatively, the ground bonding strap may be used as a connector between any number of electronics components. The ground bonding strap provides a method for properly sizing a connector between various elements by cutting the ground bonding strap into segments. The ground bonding strap may be stamped with various connectors that are marked for cutting or separation. As a result, a roll, spool or length of the ground bonding strap may be trimmed at one or more indentations of the ground bonding strap to form multiple ground bonding straps that may be sized according to a user's needs and technical requirements. The connectors stamped within the ground bonding strap provide better conductivity and a method of separating a single ground bonding strap into multiple ground bonding straps by simply cutting at the one or more indentations.

Figure 1:
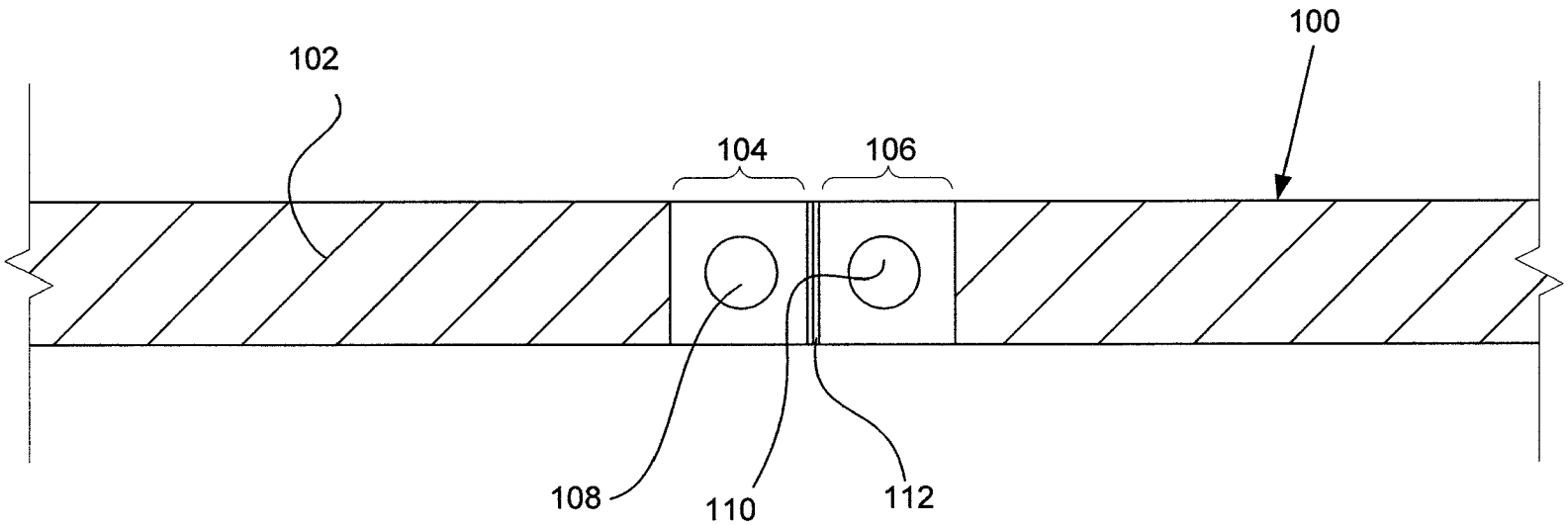
FIG. 1 is a pictorial representation of a top view of a ground bonding strap in accordance with an illustrative embodiment.

FIG. 1 is a pictorial representation of a top view of a ground bonding strap in accordance with an illustrative embodiment. The ground bonding strap 100 may include any number of elements which may include a braided cable 102, connectors 104 and 106, through holes 108 and 110, and indentation 112. The braided cable 102 is a length of cable formed or woven from one or more solid or braided cables. In one embodiment, the braided cable may include multiple wires that are braided to form the braided cable 102. In another embodiment, the braided cable 102 may be formed of multiple intertwined wires or braided cables that may be integrated for greater strength or conductivity. The braided cable 102 may be woven from any number of metals or conductive materials. The conductor or metal forming the ground bonding strap 100 may be materials, such as, copper, silver, gold, steel, iron, lead, tin, aluminum, tungsten or other similar metals.

Figure 3:
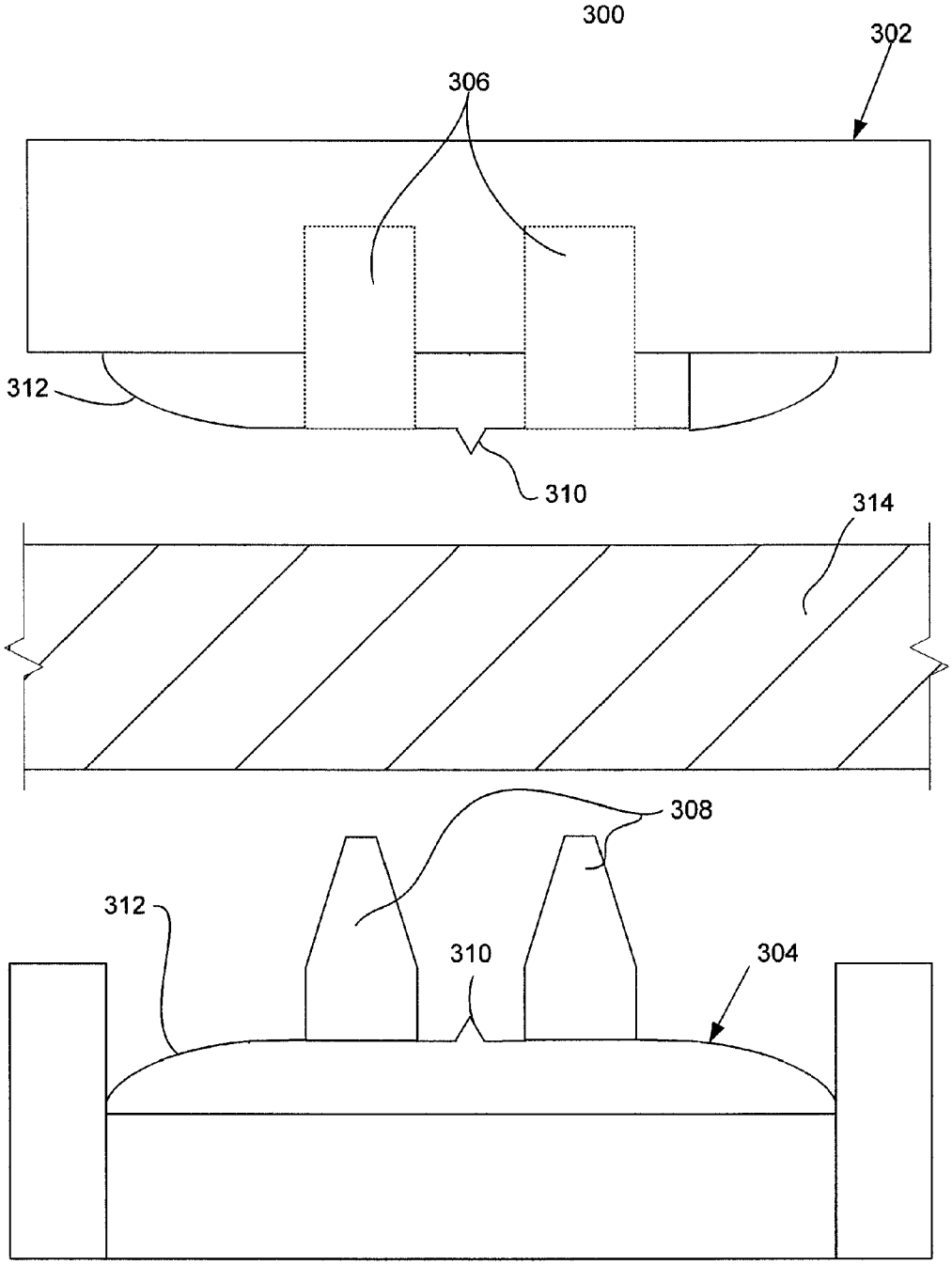
FIG. 3 is a pictorial representation of a ground bond stamp in accordance with an illustrative embodiment.

The ground bonding strap 100 may be formed by heating or stamping the braided cable 102 in order to generate the connectors 104 and 106 and the associated ground bonding strap features as further described in FIG. 3. In one embodiment, the connectors 104 and 106 include the indentation 112 and the respective through holes 108 and 110. The connectors 104 and 106 may be referred to as dual connectors or a pair of connectors. In one embodiment, the connectors 104 and 106 may be square or rectangular in shape. However, the connectors 104 and 106 may be any shape suitable for allowing the ground bonding strap 100 to be connected to one or more other elements utilizing the connectors 104 and 106, as well as their respective through holes 108 and 110. For example, the connectors 104 and 106 may be elliptically shaped and similarly marked by the indentation 112.

The indentation 112 is a groove or recess in the connectors 104 and 106. The indentation 112 may be more easily understood by reviewing the side view of FIG. 2. The indentation 112 provides a location at which the user may cut, trim or otherwise, separate the connectors 104 and 106. Despite the indention 112, the connectors 104 and 106 are securely fastened together enhancing conductivity and the grounding characteristics of the ground bonding strap 100.

The connectors 104 and 106 further define the through holes 108 and 110 or receptacles. The through holes 108 and 110 are openings or receptacles through which the connectors 104 and 106 may be connected to other elements. In one embodiment, the through holes 108 and 110 may be utilized to pass a pin, stake, wire, cable or other interface element through the connectors 104 and 106. The through holes 108 and 110 are defined within the connectors 104 and 106 during the generation of the ground bonding strap 100. The ground bonding strap 100 may include any number of connectors 104 and 106, through holes 108 and 110, and indentation 112. In one embodiment, the ground bonding strap 100 may be wrapped around a spool or otherwise stored for use.

Figure 4:
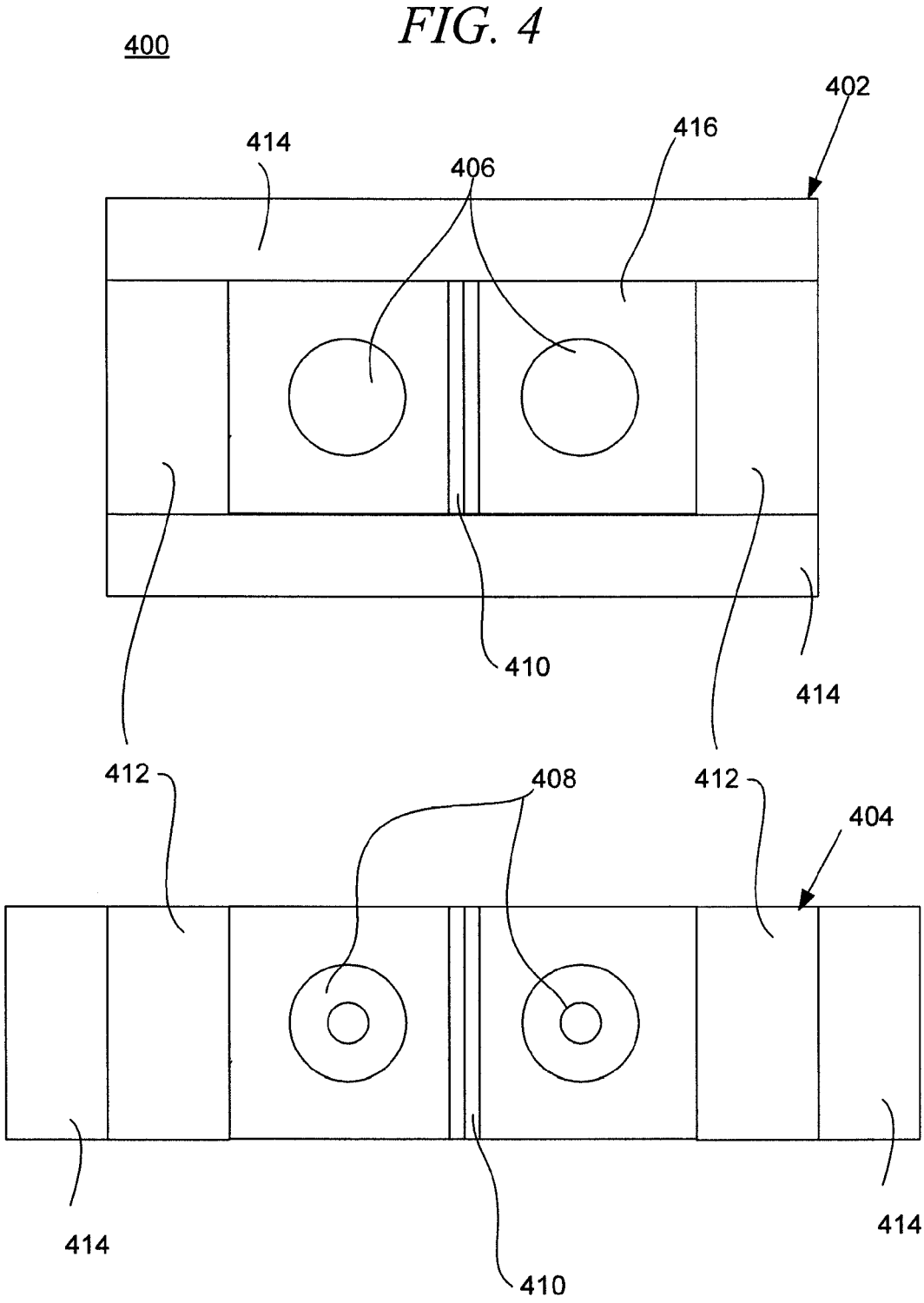
FIG. 4 is a pictorial representation of one or more ground bonding straps in accordance with an illustrative embodiment.

The ground bonding strap 100 may be separated into multiple ground bonding straps as further shown described in FIG. 4. The connectors 104 and 106 may be stamped along the entire length of the braided cable 102 so that the user may select a length of the ground bonding strap 100 to utilize in a project or other application. For example, the connectors 104 and 106, through holes 108 and 110, and indentation 112 may be repeated or stamped along the length of the braided cable 102 at regular intervals, such as every six inches. As a result, the ground bonding strap 100 may be separated into multiple ground bonding straps at six inch intervals, such as six inches, twelve inches, eighteen inches, thirty-six inches, sixty inches, and so forth.

Figure 2:
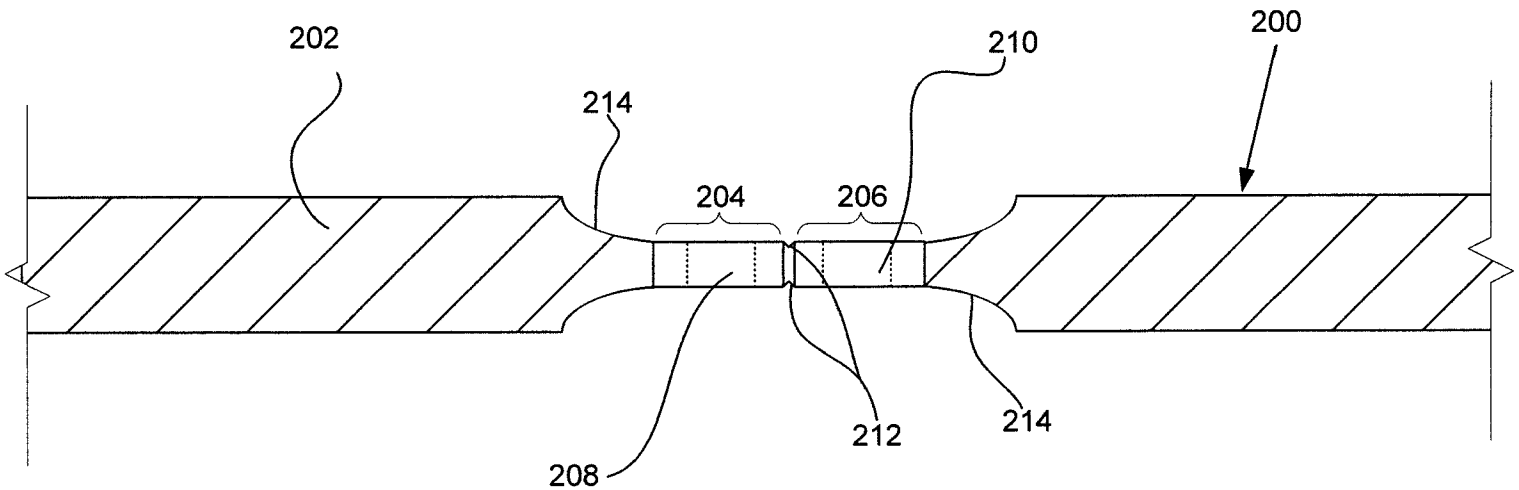
FIG. 2 is a pictorial representation of a side view of a ground bonding strap in accordance with an illustrative embodiment.

FIG. 2 is a pictorial representation of a side view of a ground bonding strap in accordance with an illustrative embodiment. The ground bonding strap 200 is a particular implementation of the ground bonding strap 100 of FIG. 1. As previously described, the ground bonding strap 200 may include a braided cable 202, connectors 204 and 206, through holes 208 and 210, indentation 212, and transitions 214. The connectors 204 and 206 may be squarely shaped for ease of use. However, the side walls of the connectors 204 and 206 may be rounded, sloped, angular or otherwise configured. The shape may be dictated by the intended use or method of manufacture. For example, sensitive equipment may require that all edges be rounded to ensure that the equipment is not damaged by sharp edges during installation.

The indentation 212 is shown on either side of the connectors 204 and 206. Although, the indentation 212 may include multiple grooves or indentations, it is referred to singularly for purposes of simplicity. Similarly, the transitions 214 include multiple elements that are referred to singularly. In another embodiment, the indentation 212 may only be present on one side of the connectors 204 and 206. The depth of the indentation 212 from either side of the connectors 204 and 206 may vary based on the intended use. For example, if the ground bonding strap 200 requires enhanced conductivity and a longer life cycle without maintenance, the indentations 212 may not be as deep. In another embodiment, the conductivity may not be a large concern and as a result, the ease of separating or cutting the connectors 204 and 206 at the indentation 212 may be more important resulting in a deeper indentation 212.

The indentation 212 may be triangularly shaped, trapezoidal or a simple groove formed between the connectors 204 and 206. The depth of the indentation 212 may vary based on the width of the connectors 204 and 206, as well as the width of the braided cable 202. For example, the ground bonding strap 200 may be used for industrial usage or consumer products which may require different technical specifications. For example, industrial applications may require that the connectors 204 and 206 are well secured, and as a result, a large cutting tool may be required to separate the connectors 204 and 206 at the indentation 212. In another example, a consumer product may require that the user be able to separate the connectors 204 and 206 utilizing a pair of pliers or diagonal cutters.

The transition 214 represents a portion of the ground bonding strap 200 separating the braided cable 202 from the connectors 204 and 206. The format and shape of the transition 214 may depend on the shape of the stamp utilized or the generation process. In one embodiment, the transition 214 may be rounded to prevent a user or equipment from being scratched during installation. Alternatively, the transition 214 may be angled or an abrupt transition between the braided cable 202 and the connectors 204 and 206.

FIG. 3 is a pictorial representation of a ground bonding stamp in accordance with an illustrative embodiment. FIG. 3 is one embodiment of a ground bonding stamp 300 and may include a punch 302, a die 304, receptacles 306, teeth 308, indentation teeth 310, and transition edges 312. The ground bonding stamp 300 may be utilized to stamp the braided cable 314. In one embodiment, the portion of the braided cable 314 shown in FIG. 3 may be heated prior to being stamped by the ground bonding stamp 300. For example, the braided cable 314 may be heated to the melting point of the material or materials utilized to form the braided cable 314. In another example, the braided cable 314 may be heated to a temperature at which the braided cable 314 becomes malleable for forming the connectors, through holes, and indentation as described in FIGS. 1 and 2.

The punch 302 and the die 304 may be integrated as part of a manufacturing or stamping mechanism. In one embodiment, the punch 302 and the die 304 may be secured to a hydraulic or a pneumatic press that is utilized to stamp the braided cable 314. For example, utilizing an assembly line, portions of the braided cable 314 may be heated utilizing a flame, welder, electrodes or other similar elements so that a portion of the braided cable 314 is heated and prepared for stamping by the punch 302 and the die 304. In particular, the teeth 308 and the receptacles 306 are used to form the through holes of the connectors. The teeth 308 may be structured to push through the braided cable 314 or otherwise separate the wires or metal of the braided cable 314 to form the through holes. The receptacles 306 provide a socket or guide for the teeth 308 and further ensure that the through holes pass through the entire width of the braided cable 314 as the braided cable 314 is compacted or pressed by the ground bonding stamp 300 to generate any number of through holes at intervals along the braided cable 314.

The indentation teeth 310 may be utilized to similarly form the indentation on either side of the braided cable 314 and the newly pressed connectors. The indentation teeth 310 and the teeth 308 may be circularly shaped, triangular, squarely shaped or otherwise formatted to generate the indentation and the through holes based on the requirements of the ground bonding strap. For example, in some cases the teeth 308 and the indentation teeth 310 may be squarely or rectangularly shaped for use with square pins, stakes or connectors in order to make cutting the ground bonding straps even easier.

FIG. 4 is a top view of a ground bonding stamp in accordance with an illustrative embodiment. The ground bonding stamp 400 is a particular implementation of the ground bonding stamp 300 of FIG. 3. The ground bonding stamp 400 may include a punch 402, a die 404, receptacles 406, teeth 408, indentation teeth 410, transition edges 412, stops 414, and connector mold 416. The ground bonding stamp 400 is shown as facing the stamping portion or face of the punch and die 404.

In one embodiment, the teeth 408 and receptacles 406 may be shaped for specialty connectors. For example, the teeth 408 and the receptacles 406 may be star-shaped. The connector mold 416 provides a mold for stamping or pressing the braided cable to form the connectors. The connector mold 416 may be further defined by the stops 414 about the periphery of the punch 402 and the die 404. The stops 414 provide a mechanism for stamping a braided cable to a specified depth. The stops 414 control the width of the connectors after stamping. Additionally, the stops 414 may prevent the heated portion of the braided cable from leaving the connector mold 416. For example, the connector mold 416 and stops 414 may ensure that the malleable portions of the braided cable do not squirt or flow out of the ground bonding stamp 400.

The ground bonding stamp 400 may be formed from a metal or other material with a substantially higher melting point than the braided cable for ensuring that stamping occurs without bonding. In another embodiment, the ground bonding stamp 400 may be coated with a material preventing the adhesion of the braided cable when stamped.

Figure 5:
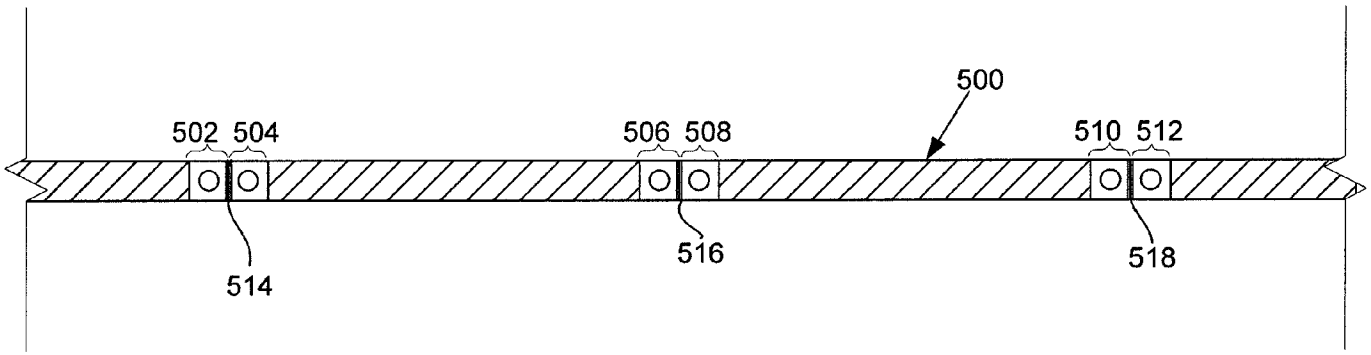
FIG. 5 is a pictorial representation of a side view of the ground bonding strap in accordance with an illustrative embodiment.

FIG. 5 is a pictorial representation of one or more ground bonding straps in accordance with an illustrative embodiment. FIG. 5 illustrates an embodiment of the ground bonding strap 500. As shown, the ground bonding strap 500 includes three dual connectors or connectors 502, 504, 506, 508, 510, and 512, and indentations 514, 516, and 518. The ground bonding strap 500 illustrates a length of ground bonding strap that may be looped, wrapped around a spool or roll or otherwise stored. The ground bonding strap may be cut at any of the indentations 514, 516, or 518 to form a ground bonding strap of a desired length. In one embodiment, the indentations 514 and 516 may be severed to form a ground bonding strap from a single segment of the ground bonding strap 500. In another embodiment, two segments may be utilized by cutting the ground bonding strap 500 at the indentation 514 and 518. The connectors 506 and 508 remain securely connected for purposes of continuity because the ground bonding strap is not severed at the indentation 516.

The use of a single segment or multiple segments may be utilized based on the needs of the user and the technical requirements of the project. In some situations, a standard installation of a phone line or cable to a user's premises may only require a single segment. In another example, installation to a condo may require that four segments be utilized because of the grounding requirements. The ground bonding strap 500 may be easily cut and separated if needed. However, the ground bonding strap 500 maintains continuity and is durable providing maintenance free usage even if various connectors are not separated. The molded or stamped construction of the ground bonding strap 500 may be much more conductive and efficient than other connectors that require multiple connector attachments or crimps be utilized to form a connector. Similarly, the ground bonding strap 500 may eliminate waste because the connectors 502, 504, 506, 508, 510, and 512, on either side of the indentations 514, 516, and 518 may be utilized.

In one embodiment, the ground bonding strap 500 may be a twenty-five foot roll of six millimeter braided cable that is stamped every six inches with the dual connectors to generate the connectors 502, 504, 506, 508, 510, and 512, and seven millimeter through holes. In another embodiment, the connectors, such as connectors 504 and 506 may be separated by twelve inches from the center of each through hole. A user may slip a plastic cover over the ground bonding strap 500 during installation for addition protection.

Figure 6:
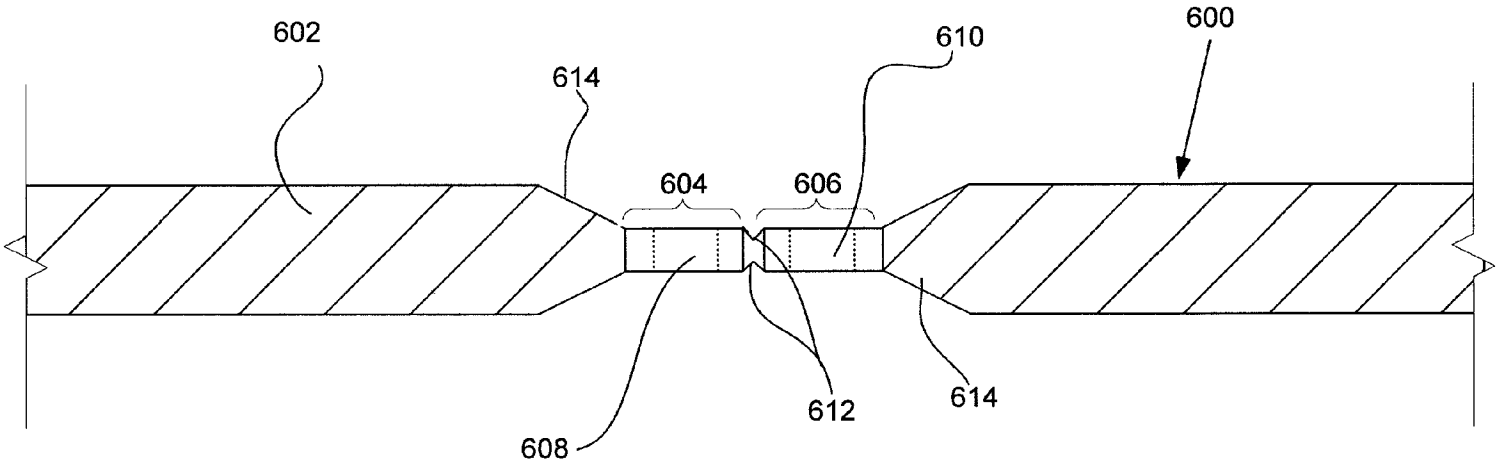
FIG. 6 is a process for generating a ground bonding strap in accordance with an illustrative embodiment.

FIG. 6 is a pictorial representation of a side view of the ground bonding strap in accordance with an illustrative embodiment. FIG. 6 is another side view of the ground bonding strap 600 that includes the elements previously described for the ground bonding strap 200 of FIG. 2 including a braided cable 602, connectors 604 and 606, through holes 608 and 610, indentation 612, and transitions 614. The ground bonding strap 600 illustrates another embodiment for the indentation 612 and transition 614. The transition 614 from the braided cable 602 to the connectors 604 and 606 may be angled. The angle of the transition 614 may be formed during the manufacturing process when the braided cable 602 is heated and stamped. The transition 614 may be configured based on the utilization of the ground bonding strap 600 or as a byproduct of forming the connectors 604 and 606.

In one embodiment, the indentation 612 is deeper from both sides of the connectors 604 and 606 for more easily cutting or separating the connectors 604 and 606 for use. The depth of the indentation 612 may depend on the cutting strength required to cut through the material forming the ground bonding strap 600 as well as the durability requirements.

Figure 7:
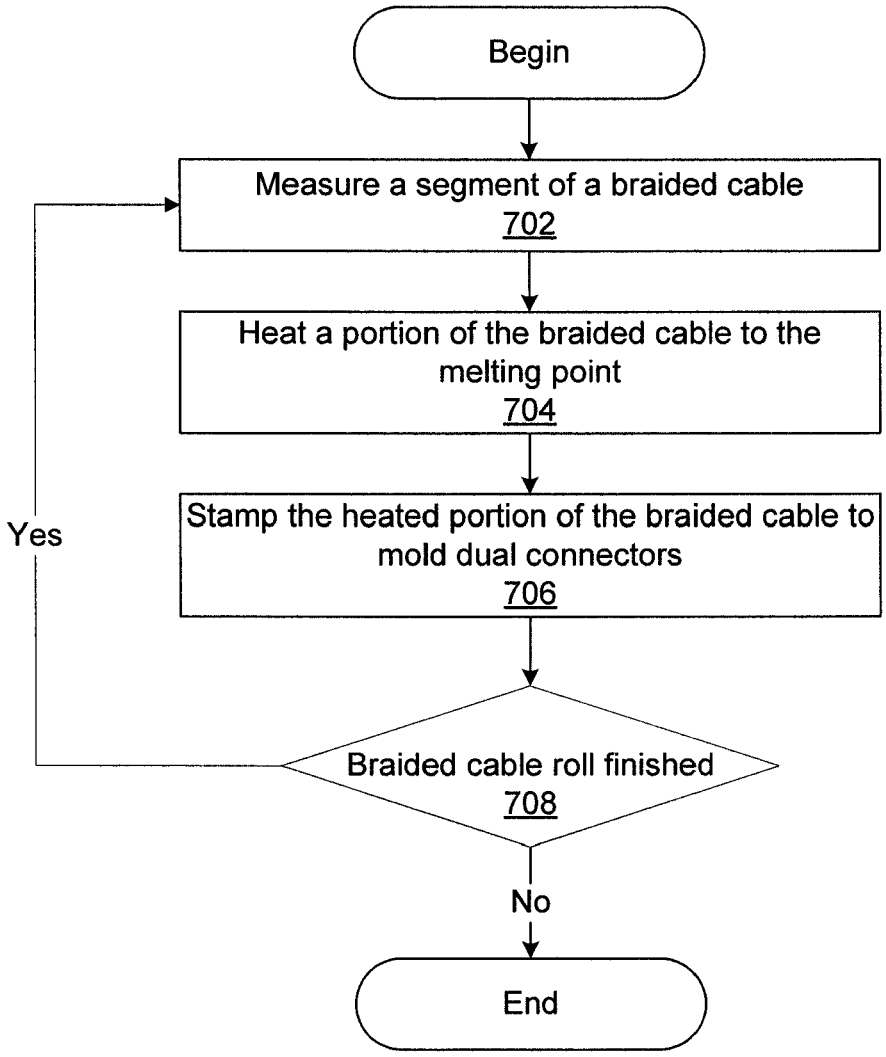
FIG. 7 is a flow chart of a process for utilizing a ground bonding strap in accordance with an illustrative embodiment.

FIG. 7 is a process for generating a ground bonding stamp in accordance with an illustrative embodiment. The process of FIG. 7 may be implemented by a stamping device in accordance with the illustrative embodiment. The stamping device may further include any number of rollers, torches, electrodes, spools, pulleys or other elements for feeding, heating, and managing the braided cable before it is stamped to produce a ground bonding strap. The process may begin with the stamping device measuring a segment of a braided cable (step 702). The segment length of the braided cable may be specified based on the utilization of the ground bonding strap. For example, the segment may be approximately six inches for telecommunications applications, and in another embodiment, the segment length may be two feet for use in power line installation.

Next, the stamping device heats a portion of the braided cable to a melting point (step 704). The melting point of the braided cable may be dependent upon one or more of the materials or wires woven together to form the braided cable. In another embodiment, the braided cable may be heated to a temperature at which the braided cable becomes malleable in order to allow the stamping device to stamp the braided cable without excessive power or force requirements. A lower temperature may also be utilized to insure that the braided cable does not enter a liquid state that becomes unmanageable by the stamping device.

Next, the stamping device stamps the heated portion of the braided cable to mold dual connectors (step 706). In one embodiment, the ground bonding stamp may utilize a punch and die with any number of teeth, protuberances, receptacles or sockets to form the through holes and indentations that are part of each of the dual connectors. The dual connectors are the two connectors that are stamped within close proximity to one another at the heated portion of the braided cable. In another embodiment, the stamp may use a mill or saw to generate the indention or connectors.

Next, the stamping device determines whether the braided cable roll is finished (step 708). If the braided cable roll is finished, the process terminates. If the braided cable roll is not finished in step 708, the stamping device measures a segment of the braided cable (step 702) before continuing to stamp the braided cable at the predefined intervals specified by the segment length.

Figure 8:
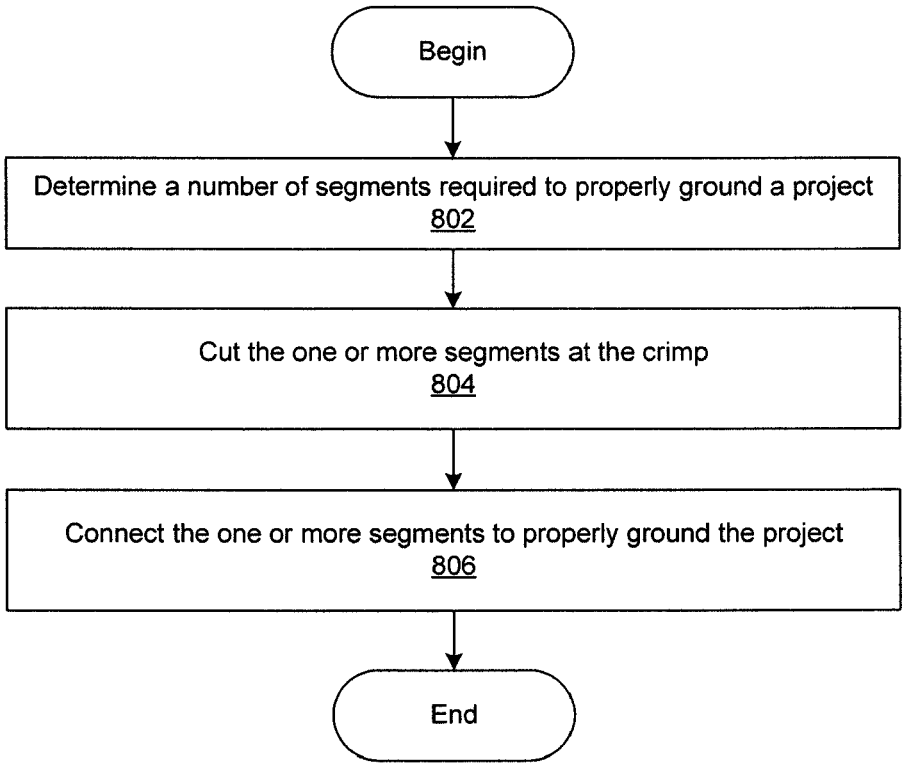
FIG. 8 is a flow chart of a process for utilizing a ground bonding strap in accordance with the illustrative embodiment.

FIG. 8 is a flow chart of a process for utilizing a ground bonding strap in accordance with the illustrative embodiment. The process of FIG. 8 may be implemented by a user utilizing a roll, spool or length of the ground bonding strap. The process may begin with the user determining a number of segments required to properly ground a project (step 802). The number of segments may depend upon the intervals at which the connectors and corresponding indentations are spaced along the length of the ground bonding strap.

Next, the user cuts the one or more segments of the ground bonding strap at the indentation (step 804). The user may utilize any number of tools or methods to cut the ground bonding strap. In one embodiment, the user may utilize a pair of diagonal cutters, utility scissors or pliers. In another embodiment, the user may be required to use a hydraulic or pneumatic tool based on the width and strength of the ground bonding strap.

Next, the user connects the one or more segments of the ground bonding strap to properly ground the project (step 806). The segments of the ground bonding strap may be connected utilizing other wires, cables, pins, stakes, nuts and bolts, screws, welds or other connections, elements, devices, means or methods.

Figure 9:
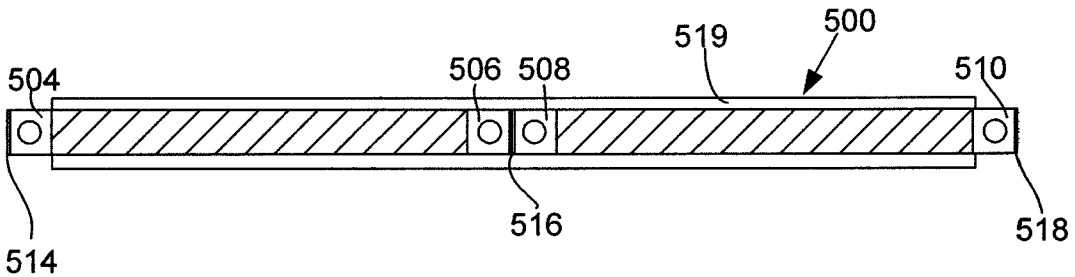
FIG. 9 is a pictorial representation of a cut ground bonding strap in accordance with an illustrative embodiment.

FIG. 9 is a pictorial representation of a cut ground bonding strap in accordance with an illustrative embodiment. FIG. 9 illustrates an embodiment of the ground bonding strap 500. As shown, the ground bonding strap 500 includes connectors 504, 506, 508, and 510 and indentations 514, 516, and 518, and slidable cover 519.

The ground bonding strap 500 as shown has been cut or otherwise separated at indentations 514 and 518 to a length desired by a user. In one embodiment, the slidable cover 519 may be slipped over the ground bonding strap. As shown, two segments may be utilized by cutting the ground bonding strap 500 at the indentation 514 and 518. The ground bonding strap 500 provides a ground or electrical connection between the connectors 504 and 510 through the connectors 506 and 508 that remain interconnected for completing the electrical connection. Any number of segments may be utilized to customize the size of the ground bonding strap 500 by cutting at one or more indentations between a pair of connectors and the associated through holes. For example, the connectors 504 and 510 define the ends of the ground bonding strap 500.

The previous detailed description is of a small number of embodiments for implementing the invention and is not intended to be limiting in scope. The following claims set forth a number of the embodiments of the invention disclosed with greater particularity.

The previous detailed description is of a small number of embodiments for implementing the invention and is not intended to be limiting in scope. The following claims set forth a number of the embodiments of the invention disclosed with greater particularity.

What is claimed is:

1. A stamp for a ground bonding strap, the stamp comprising:

a heating element operable to heat a segment of a cable for stamping at intervals of a length of the cable;

a die including a pair of teeth operable to stamp a first side of the segment to form a pair of connectors, the die including a first indentation tooth for forming an indentation separating the pair of connectors;

a punch defining a pair of sockets operable to stamp a second side of the segment to form the pair of connectors, the sockets being operable to receive the teeth as pushed through the cable to form a pair of through holes within the pair of connectors, the punch including a second indentation tooth for forming the indentation separating the pair of connectors; and a hydraulic press connected to the punch and the die operable to press the punch and the die together at the heated segment of the cable to form the pair of connectors, the stamp forming a mold to shape the pair of connectors and define the indentation and the through holes.

2. The stamp according to claim 1, further comprising:

a stop around the periphery of the die and the stamp ensuring that the cable is stamped to a predefined depth, and wherein the stop defines the edges of the pair of connectors as stamped.

3. The stamp according to claim 1, wherein the stamp is formed from a material with a substantially higher melting point than the cable, wherein the cable is a braided cable, and wherein the indentation teeth are triangularly shaped.

4. The stamp according to claim 1, wherein the heating element heats the segment until the cable becomes malleable.

5. The stamp according to claim 1, further comprising:

a stop defining a periphery of the stamp to prevent molten material from exiting the stamp.

6. The stamp according to claim 1, wherein the heating element is at least one of flame-based, weld-based, or electrode-based.

7. The stamp according to claim 1, wherein the indentation tooth has a shape comprising one of circular, triangular, square, or rectangular, such that the indentation separating the pair of connectors, when formed by the indentation tooth, has corresponding circular, triangular, square, or rectangular shape.

8. The stamp according to claim 1, wherein the pair of teeth each has a shape comprising one of circular, triangular, square, rectangular, or star, such that the pair of through holes, when formed by the pair of teeth, has corresponding circular, triangular, square, rectangular, or star shape.

9. The stamp according to claim 1, wherein the die further includes a first pair of transition edges extending from the pair of teeth to a peripheral side edge of the die to form a first transition between each of the pair of connectors and an unstamped portion of the cable, wherein the punch further includes a second pair of transition edges extending from the pair of sockets to a peripheral side edge of the punch to form a second transition between each of the pair of connectors and the unstamped portion of the cable.

10. The stamp according to claim 1, further comprising:

a plurality of rollers for feeding the cable toward the die and the punch for stamping the first and second sides of the segment; and at least one of a plurality of electrodes, a plurality of spools, and a plurality of pulleys for managing the cable while the cable is being fed by the plurality of rollers.

11. A method of using a stamp for a ground bonding strap, the method comprising:

providing a ground bonding stamp comprising:

a heating element operable to heat a segment of a cable for stamping at intervals of a length of the cable;

a die including a pair of teeth operable to stamp a first side of the segment to form a pair of connectors, the die including an indentation tooth for forming an indentation separating the pair of connectors;

a punch defining a pair of sockets operable to stamp a second side of the segment to form the pair of connectors, the sockets being operable to receive the teeth as pushed through the cable to form a pair of through holes within the pair of connectors, the punch including the indentation tooth for forming the indentation separating the pair of connectors; and a hydraulic press connected to the punch and the die operable to press the punch and the die together at the heated segment of the cable to form the pair of connectors;

heating, using the heating element, the segment of the cable; and stamping, using the hydraulic press connected to the punch and the die, the heated segment of the cable to form the pair of connectors for the segment, to form the indentation separating the pair of connectors, to form the pair of through holes within the pair of connectors, the stamp forming a mold to shape the pair of connectors and define the indentation and the though holes.

12. The method according to claim 11, wherein the ground bonding stamp further comprises:

a stop around the periphery of the die and the ground bonding stamp ensuring that the cable is stamped to a predefined depth, and wherein the stop defines the edges of the pair of connectors as stamped.

13. The method according to claim 11, wherein the ground bonding stamp is formed from a material with a substantially higher melting point than the cable, wherein the cable is a braided cable, and wherein the indentation teeth are triangularly shaped.

14. The method according to claim 11, wherein the heating element heats the segment until the cable becomes malleable.

15. The method according to claim 11, wherein the ground bonding stamp further comprises:

a stop defining a periphery of the ground bonding stamp to prevent molten material from exiting the ground bonding stamp.

16. The method according to claim 11, wherein the heating element is at least one of flame-based, weld-based, or electrode-based.

17. The method according to claim 11, wherein the indentation tooth has a shape comprising one of circular, triangular, square, or rectangular, such that the indentation separating the pair of connectors, when formed by the indentation tooth, has corresponding circular, triangular, square, or rectangular shape.

18. The method according to claim 11, wherein the pair of teeth each has a shape comprising one of circular, triangular, square, rectangular, or star, such that the pair of through holes, when formed by the pair of teeth, has corresponding circular, triangular, square, rectangular, or star shape.

19. The method according to claim 11, wherein the die further includes a first pair of transition edges extending from the pair of teeth to a peripheral side edge of the die to form a first transition between each of the pair of connectors and an unstamped portion of the cable, wherein the punch further includes a second pair of transition edges extending from the pair of sockets to a peripheral side edge of the punch to form a second transition between each of the pair of connectors and the unstamped portion of the cable.

20. The method according to claim 11, wherein the ground bonding stamp further comprises:

a plurality of rollers for feeding the cable toward the die and the punch for stamping the first and second sides of the segment; and at least one of a plurality of electrodes, a plurality of spools, and a plurality of pulleys for managing the cable while the cable is being fed by the plurality of rollers.

* * * * *